US006375492B1

(12) United States Patent
Hio

(10) Patent No.: US 6,375,492 B1
(45) Date of Patent: Apr. 23, 2002

(54) TERMINAL CONSTRUCTION OF FLAT CONDUCTOR

(75) Inventor: Masahide Hio, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/704,951

(22) Filed: Nov. 2, 2000

(30) Foreign Application Priority Data

Nov. 4, 1999 (JP) ..... 11-314242

(51) Int. Cl.[7] ..... H01R 4/24
(52) U.S. Cl. ..... 439/422; 439/495
(58) Field of Search ..... 439/495, 422, 439/423, 424, 397, 492, 499

(56) References Cited

U.S. PATENT DOCUMENTS

| | | | | |
|---|---|---|---|---|
| 3,703,604 A | * | 11/1972 | Henschen et al. | 439/492 |
| 3,966,295 A | * | 6/1976 | Hyland et al. | 439/492 |
| 4,040,702 A | | 8/1977 | McKee et al. | 439/422 |
| 4,082,402 A | | 4/1978 | Kinkaid et al. | 439/422 |
| 4,188,714 A | * | 2/1980 | Jean | 439/492 |
| 4,561,714 A | * | 12/1985 | Byczek et al. | 439/492 |
| 4,834,673 A | * | 5/1989 | Beinhaur et al. | 439/422 |
| 6,068,505 A | * | 5/2000 | Sai | 439/422 |
| 6,135,779 A | * | 10/2000 | Koch et al. | 439/422 |
| 6,152,763 A | * | 11/2000 | Sai | 439/492 |

FOREIGN PATENT DOCUMENTS

| | | |
|---|---|---|
| JP | 63-73861 | 4/1988 |
| JP | 63-73862 | 4/1988 |

* cited by examiner

*Primary Examiner*—Hien Vu
(74) *Attorney, Agent, or Firm*—Anthony J. Casella; Gerald E Hespos

(57) ABSTRACT

In terminals of an FFC (10), an upper-side insulation sheet (12) is torn off in a predetermined range to expose an upper side of conductive paths (11) and leave conductive path-disposing portions of the FFC (10) in the shape of the teeth of a comb to form connection regions (14). A terminal fitting (20) has a bottom plate (22) and a ceiling plate (23) both extended rearward from a connection part (21), such that the ceiling plate (23) can be opened and closed. Each of the connection regions (14) is pressed and sandwiched between the bottom plate (22) and the ceiling plate (23). A crimping piece (29) of the bottom plate (22) is crimped to a side edge of the ceiling plate (23), with the connection region (14) held in the crimping piece (29). The entire terminal fittings (20) are accommodated in cavities (41) of a connector housing (40) respectively, with the connection regions (14) connected to the terminal fittings (20) respectively. The cavities (41) can accommodate a terminal fitting (20A) of crimping type connected to a terminal of a covered electric wire (55) and a terminal fitting (20B) of pressure connection type connected to the terminal thereof.

2 Claims, 5 Drawing Sheets

TERMINAL CONSTRUCTION OF FLAT CONDUCTOR

BACKGROUND OF THE INVENTION

1. Field of the Invention

The present invention relates to the construction of a terminal or end portion of a flat conductor.

2. Description of the Related Art

Prior art flat conductors include an FFC (flexible flat cable) and an FPC (flexible print circuit board). As shown in FIG. 7, an FFC 1 has a plurality of conductive paths 2 arranged in parallel with one another and sandwiched between insulation sheets 3 that are disposed on the upper and lower surfaces of the conductive paths 2. The FFC 1 is flexible and has the shape of a ribbon. The FFC 1 may be used with a terminal fitting 4 that has a connection part 5 to be connected to a mating terminal fitting and a barrel 6 positioned rearward of the connection part 5. The barrel 6 of each terminal fitting 4 is crimped to a corresponding conductive path 2 to connect each terminal fitting 4 to a conductive path 2. Thus, the respective connection parts 5 project in parallel with each other from the terminal or end portion of the FFC 1. The terminal fittings 4 then are accommodated in cavities formed in a connector housing 7.

The terminal construction of the FFC is disclosed in Japanese Patent Publication No. 7-54720.

The connector housing 7 typically is constructed to accommodate the connection part 5 of the terminal fitting 4 and as much as possible of the remainder of the terminal fitting 4 in the longitudinal direction, including the barrel 6. The respective barrels 6 of the terminal fittings 4 are fixed to the terminals of the FFC 1 connected with one another in series. Thus, to accommodate the entirety of the terminal fitting 4 in the connector housing 7, it is necessary to form an escape opening 8 at the entrance to the cavity for fitting portions of the FFC 1. More particularly, the cavities must be joined into the single escaping opening 8 at least at the rear entrance to the cavities.

It is unnecessary to form an escape opening on a connector housing for terminal fittings that are mounted on the ends of conventional electric wires. Thus, it is necessary to prepare the connector housing 7 dedicated to the terminal fittings 4 connected to the terminal or end portion of the FFC 1.

The present invention has been completed in view of the above-described situation. Thus, it is an object of the present invention to provide a terminal construction of a flat conductor that can be accommodated in a general-purpose connector housing.

SUMMARY OF THE INVENTION

The subject invention is directed to a construction of terminals or end portions of a flat conductor to be inserted into a connector housing. The connector housing is formed to include a plurality of cavities. Terminal fittings are connected individually to conductive paths disposed in an insulation sheet of the flat conductor and are fixed respectively to the terminals or end portions of the flat conductor. In this construction, portions of the flat conductor to be inserted into the cavity are formed separately from each other.

The terminals or end portions of the flat conductor preferably consist of a plurality of separate portions formed for each conductive path-disposing position. The terminal fittings are connected to the separate portions respectively.

The above described construction of a flat conductor and terminal fittings can be utilized with a general-purpose connector housing in which the cavities are formed individually and extend along the entire length of the terminal fitting. Thus, it is possible to accommodate the terminal fitting in each cavity. In addition, it is possible to use the connector housing for both the terminal fitting connected to the flat conductor and terminal fittings fixed to an ordinary covered electric wire.

It is also possible to use a short and compact terminal fitting.

DETAILED DESCRIPTION OF THE PREFERRED EMBODIMENTS

An embodiment of the present invention will be described below with reference to FIGS. 1 through 6.

Figure 1:
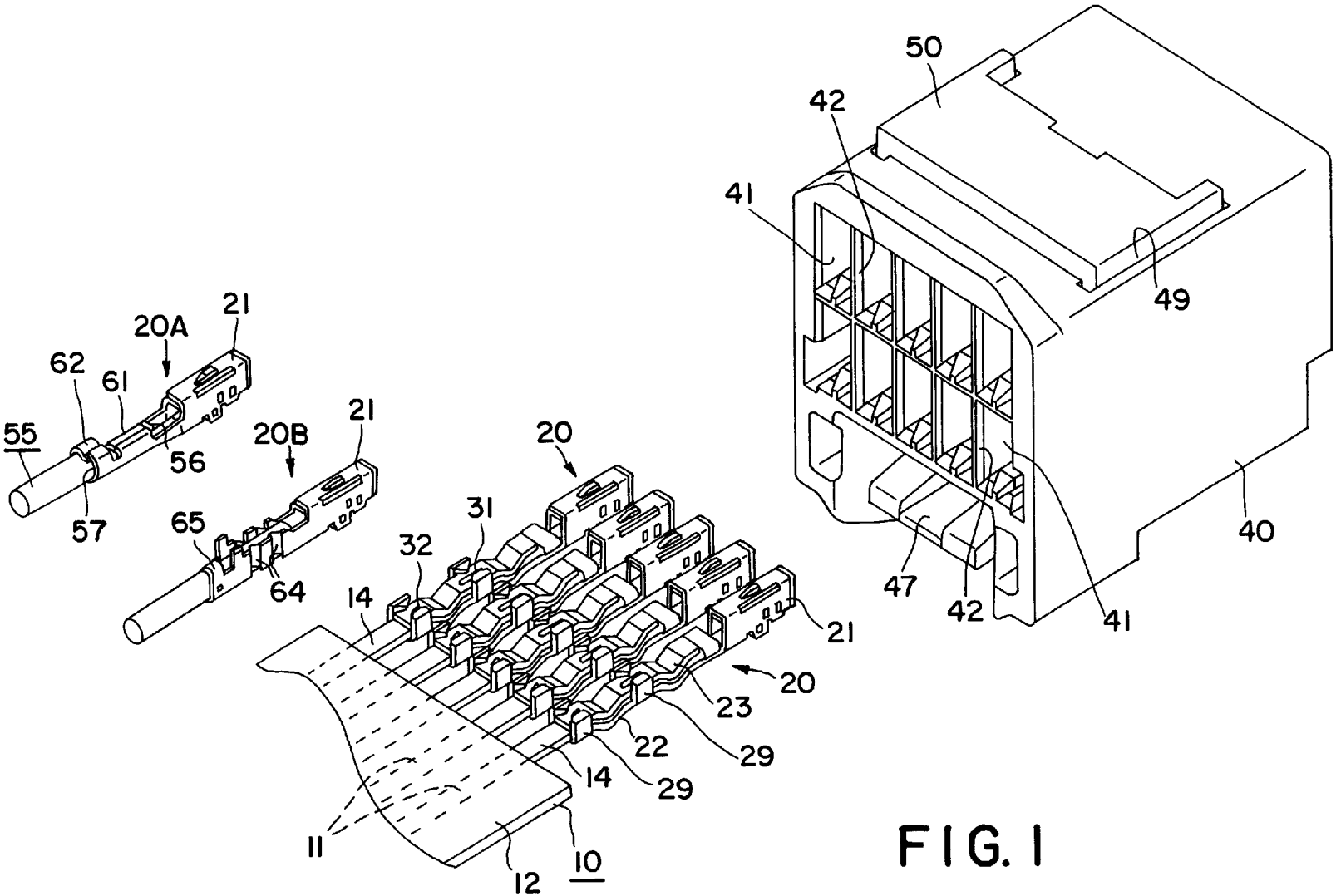
FIG. 1 is a perspective view showing a state before a terminal fitting-connected flat conductor of an embodiment of the present invention is not inserted into a connector housing.

The subject invention is directed to an assembly of terminal fittings 20 and a connector housing 40 that can be used with an FFC (flat flexible cable) 10, as shown in FIGS. 1 through 6. The FFC 10 is illustrated as one possible flat conductor. However, other flat conductors, such as FPC's may be employed. As shown in FIG. 1, five terminal fittings 20 are fixed to the end of the FFC 10, and the terminal fittings 20 are inserted individually into cavities 41 formed in the connector housing 40.

Figure 2:
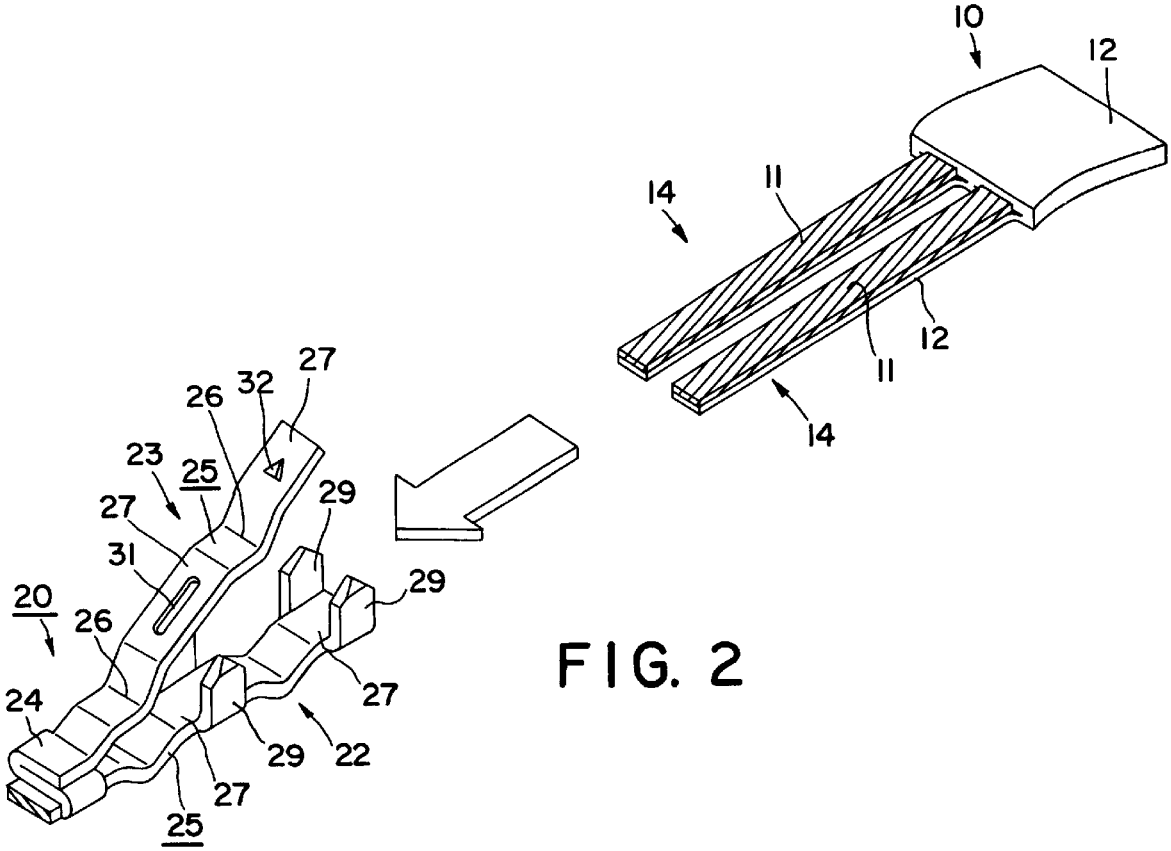
FIG. 2 is a perspective view showing the terminal fitting of FIG. 1 not connected to the FFC.

The five conductive paths 11 of the FFC 10 are arranged in parallel with one another at predetermined intervals and are embedded in insulation sheets 12 disposed on upper and lower surfaces of the conductive paths 11 to form the flexible ribbon-shaped FFC 10. The end of the FFC 10, as shown in FIG. 2, has the upper-side insulation sheet 12 torn off in a predetermined range to expose the upper side of the conductive paths 11 and to leave the conductive path-disposing portion in the shape of the teeth of a comb to form five connection regions 14. The lower surface of the insulation sheet 12 also may be torn off from the FFC 10.

The terminal fitting 20 is formed as a female terminal fitting by press-molding a plate of a highly electrically conductive metal. The terminal fitting 20 has a box-shaped connection part 21 (not shown in FIG. 2) that can be fitted on a tab (not shown) of a mating male terminal fitting. The terminal fitting 20 also has a bottom plate 22 that extends rearward from the rear end of the connection part 21. A ceiling plate 23 is formed integrally with a coupling part 24, as shown in FIG. 2. The ceiling plate can be pivoted from the open position shown in FIG. 2 to a substantially closed position with the ceiling plate 23 confronting the bottom plate 22. The length of the region in which the bottom plate 22 and the ceiling plate 23 confront each other is a little shorter than that the length of the connection region 14 on the FFC 10. The width of the bottom plate 22 and the width of the ceiling plate 23 are almost equal to the width of the connection region 14 on the FFC 10.

As shown in FIG. 2, the bottom plate 22 and the ceiling plate 23 each have a wavy part 25 with two valleys 26 spaced at a certain interval in the longitudinal direction thereof. The positions of both wavy parts 25 enable the bottom plate 22 and the ceiling plate 23 to nest with each other. Front and rear flat portions 27 are formed forward and rearward of the rear valley 26. The bottom plate 22 has a pair of crimping pieces 29 erected from the respective side edges of the flat portion 27 disposed at the rear end of the bottom plate 22. Another pair of crimping pieces 29 is erected from the respective side edges of the flat portion 27, and is disposed between both valleys 26 of the bottom plate 22.

The ceiling plate 23 includes a convexity 31 that projects down from the lower surface of the widthwise center region of the flat portion 27 positioned between both valleys 26. Additionally, the convexity 31 extends in the longitudinal direction of the ceiling plate 23. A wedge-shaped cutting projection 32 projects down from lower surface of the flat portion 27 at the rear end of the ceiling plate 23.

As shown in FIG. 2, the ceiling plate 23 of the terminal fitting 20 is pivoted to the open position, and the connection region 14 of the FFC 10 is inserted between the ceiling plate 23 and the bottom plate 22 to bring the connection region 14 into contact with the coupling part 24. Additionally, the left and right crimping pieces 29 are aligned with the connection region 14. The ceiling plate 23 then is closed. As a result, the connection region 14 is pressed and sandwiched between the ceiling plate 23 and the bottom plate 22. Thereafter, the crimping pieces 29 of the bottom plate 22 are crimped to the side edge of the ceiling plate 23, with the connection region 14 being held between the bottom plate 22 and the ceiling plate 23 by the crimping pieces 29.

Figure 3:
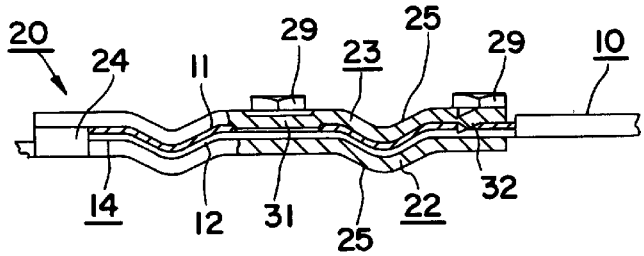
FIG. 3 is a partly cutout side view showing the terminal fitting connected to the FFC.

Consequently, as shown in FIG. 3, each connection region 14 is bent wavily to conform to the configuration of the wavy part 25 of each of the ceiling plate 23 and that of the bottom plate 22. Additionally, the convexity 31 formed on the ceiling plate 23 is pressed against and sticks into the conductive path 11. Therefore, the convexity 31 and the conductive path 11 are connected to each other at a high pressure. Further, the cutting projection 32 cuts into the conductive path 11, thus preventing the ceiling plate 23 from slipping off the conductive path.

Figure 4:
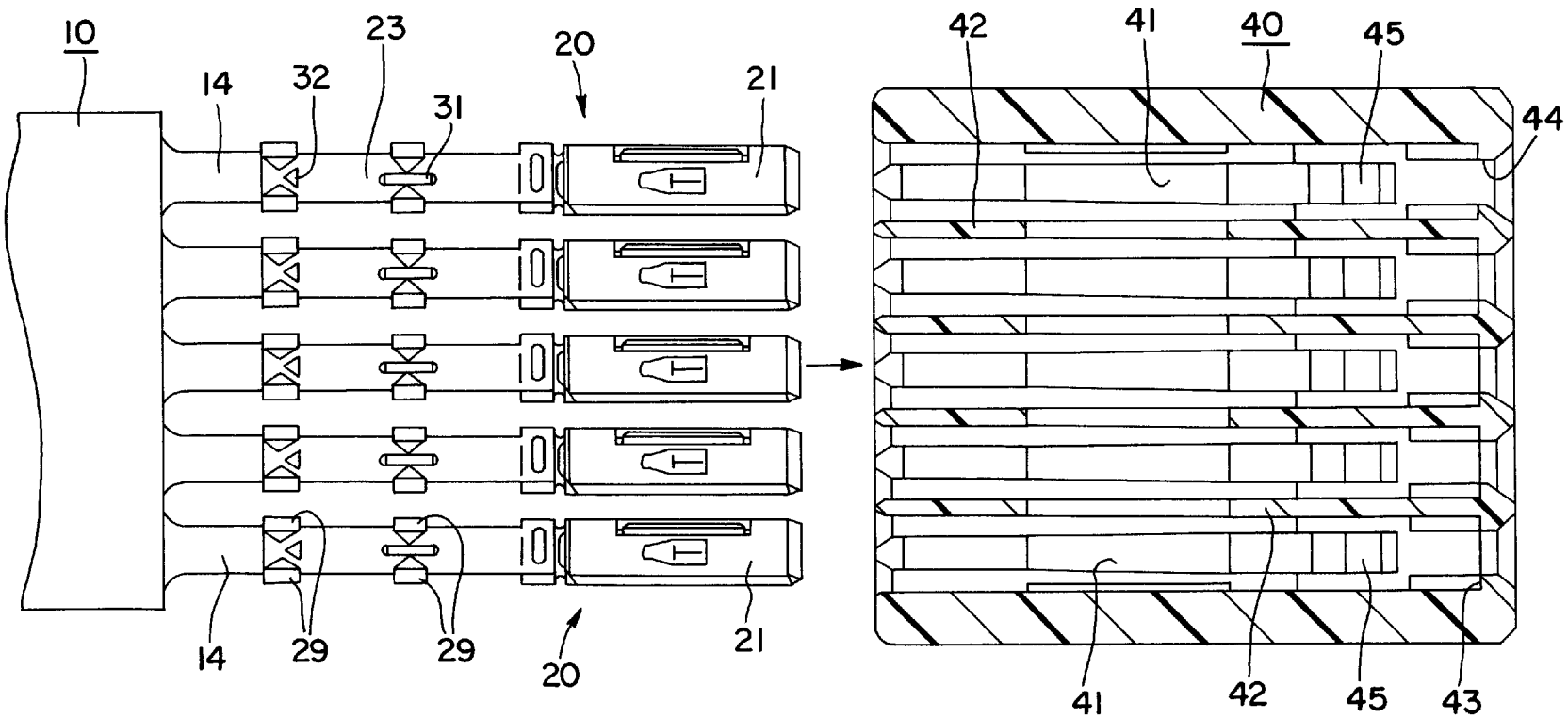
FIG. 4 is a partly cutout plan view showing a state before the terminal fittings connected to the FFC are inserted into the connector housing.
Figure 6:
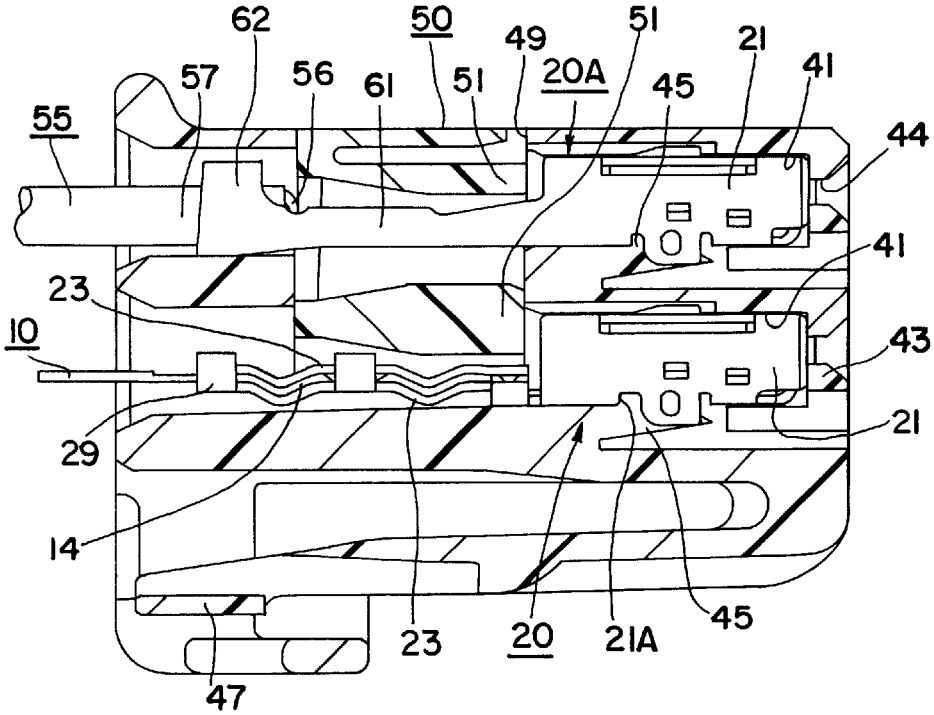
FIG. 6 is a vertical sectional view showing a state in which the terminal fittings have been accommodated in the connector housing.
Figure 7:
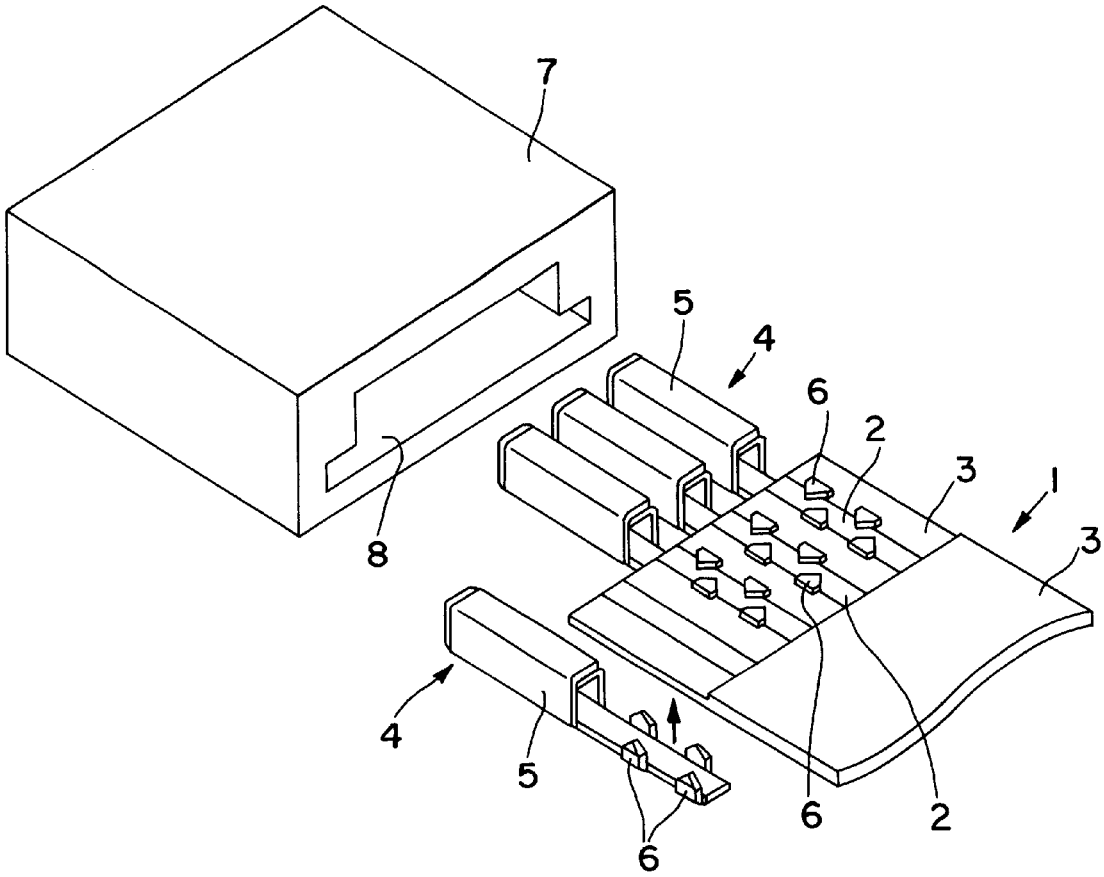
FIG. 7 is a perspective view showing a conventional flat conductor not inserted into a connector housing.

As shown in FIG. 1, the connector housing 40 is made of synthetic resin and is block-shaped. Cavities 41 are formed inside the connector housing 40 such that five cavities 41 are disposed at upper and lower stages, respectively. As shown in FIG. 4, the cavities 41 are partitioned from each other with partitioning walls 42. Terminal insertion openings 44 are formed at the front surfaces 43 of the respective cavities 41. The terminal insertion openings 44 are dimensioned to accommodate tabs of unshown male terminal fittings. As shown in FIG. 6, an elastically deformable lance 45 is formed on the bottom surface of each of the cavities 41. Furthermore, each cavity 41 is long enough to accommodate the entire terminal fitting 20.

The bottom surface of the connector housing 40 is formed with a locking arm 47 for locking the connector housing 40 and an unshown mating male connector housing to each other. A retainer insertion opening 49 is formed on the upper surface of the connector housing 40. Although detailed description is not made herein, a side-type retainer 50 is inserted into the retainer insertion opening 49. When the retainer 50 is pressed to a predetermined position, a locking portion 51 formed on the retainer 50 is capable of locking the rear surface of the connection part 21 of the terminal fitting 20 (see FIG. 6).

In addition to the terminal fitting 20 for the FFC 10, a crimping type of terminal fitting 20A and a pressure connection type of terminal fitting 20B can be inserted into the cavities 41 of the connector housing 40. More particularly, as shown in FIG. 1, the crimping type of terminal fitting 20A has a length almost equal to the length of the terminal fitting 20 for the FFC 10. The crimping type of terminal fitting 20A has a connection part 21 with the same shape as the connection part 21 of the terminal fitting 20 for the FFC 10. The terminal fitting 20A also has a wire barrel 61 rearward from the connection part 21, and an insulation barrel 62 rearward from the wire barrel 61. The end of a covered electric wire 55 has its core wire 56 exposed and then is inserted into the terminal fitting 20A. The wire barrel 61 and the insulation barrel 62 then are crimped respectively to the exposed core wire 56 and to a portion of a coating member 57 near the exposed core wire 56. In this manner, the terminal fitting 20A is fixedly connected to the terminal of the covered electric wire 55.

The pressure connection type of terminal fitting 20B also has a length almost equal to the length of the terminal fitting 20 for the FFC 10. The pressure connection type of terminal fitting 20B has a connection part 21 with a shape that is the same as the shape of the crimping type terminal fitting 20A. The terminal fitting 20B also has two pressure connection blades 64 positioned rearward from the connection part 21, and a barrel 65 positioned rearward from the blades 64. The terminal of the covered electric wire 55 is inserted sideways into the terminal fitting 20B and is pressed against the pressure connection blades 64, with the rear portion of the covered electric wire 55 crimped with the barrel 65. In this manner, the terminal fitting 20B is fixedly connected to the terminal of the covered electric wire 55.

Initially, the retainer 50 is installed on the connector housing 40 at a temporary locking position as shown in FIG. 1. At the temporary locking position, a locking portion 51 of the retainer 50 is located at an upper portion of the cavity 41. In the illustrated embodiment, five terminal fittings 20 are connected to the respective terminals of the FFC 10 and are accommodated in the lower-stage cavity 41 of the connector housing 40. In this case, as shown with the arrow of FIG. 4, the five terminal fittings 20 are inserted into the corresponding cavities 41, with the five terminal fittings 20 facing the rear surface of the connector housing 40.

Figure 5:
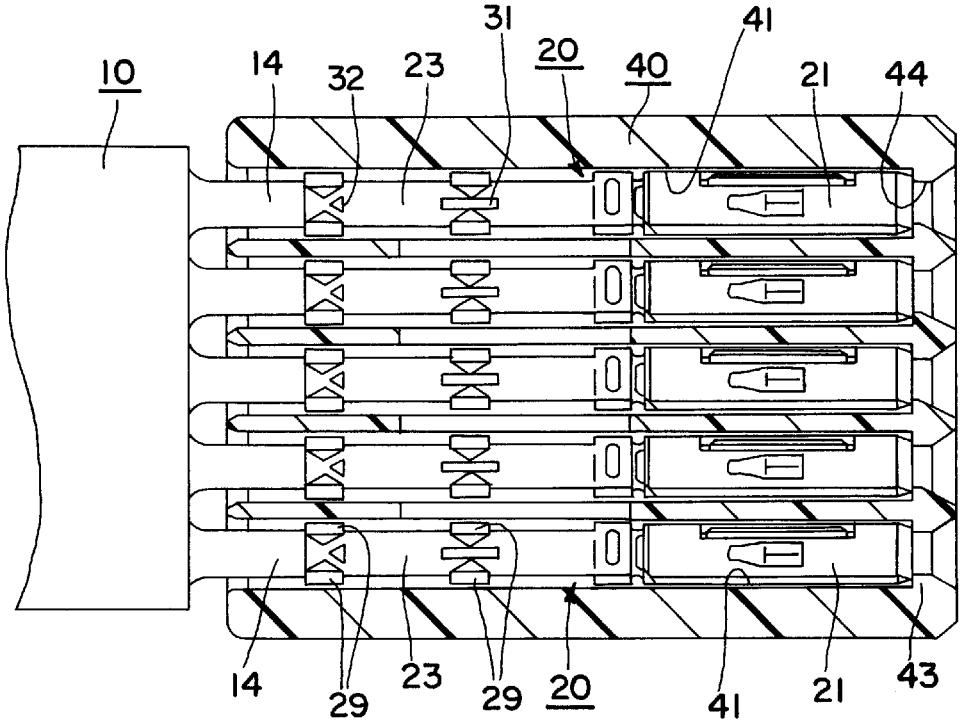
FIG. 5 is a cross-sectional view showing a state in which the terminal fittings have been inserted into the connector housing.

Each terminal fitting 20 is pressed inward into the corresponding cavity 41, such that the terminal fitting 20 elastically deforms the lance 45. After sufficient insertion, the terminal fitting 20 will strike the front surface 43 of the connector housing 40, as shown in FIGS. 5 and 6. In this position, the terminal fitting 20 fits in a locking hole 21A formed on the lower surface of the connection part 21, with the lance 45 deformably returning to its original state. Thus the terminal fitting 20 achieves a primary locking in the cavity 41 to prevent the terminal fitting from slipping out from the cavity 41.

In the illustrated embodiment, the crimping-type terminal fitting 20A fixed to the terminal of the covered electric wire 55 is inserted into the upper-stage cavity 41. As in the case of the terminal fitting 20, the terminal fitting 20A is pressed inward into the corresponding cavity 41, with the terminal fitting 20A elastically deforming the lance 45. When the terminal fitting 20A is pressed to a predetermined position, the lance 45 achieves primary locking of the terminal fitting 20A in the cavity 41. When the terminal fittings 20A are inserted into all the upper-stage cavities 41, the retainer 50 is pressed to a main locking position shown in FIG. 6. As a result, the locking portion 51 of the retainer 50 locks to the rear surface of the connection part 21 of each of the terminal fitting 20A accommodated in the upper-stage cavities 41 and the terminal fittings 20 accommodated in the lower-stage cavities 41. In this manner, the terminal fittings 20A and 20 are locked doubly.

In this state, the connector housing 40 fits on the mating male connector housing.

Instead of the crimping-type terminal fitting 20A, the pressure connection-type terminal fitting 20B may be inserted into the upper-stage cavity 41.

The terminal fitting 20 connected to the FFC 10 may be accommodated in either the upper-stage cavities 41 or the lower-stage cavities 41. It is also possible to accommodate any selected combination of the terminal fitting 20 for the FFC, the crimping-type terminal fitting 20A, and the pressure connection-type terminal fitting 20B in the upper-stage and lower-stage cavities 41.

As described above, the terminals of the FFC 10 consist of a plurality of separate connection regions 14 formed for each conductive path-disposing position, and the terminal fittings 20 are connected to the respective connection regions 14. Therefore, in accommodating the terminal fitting 20 in the connector housing 40, it is possible to utilize the general-purpose connector housing 40 in which the cavities 41 are formed individually in the entire length of the terminal fitting 20. It is also possible to use the connector housing 40 for the terminal fitting 20, the crimping type terminal fitting 20A and the pressure connection type terminal fitting 20B fixed to the covered electric wire 55.

The connection region 14 is formed by cutting the FFC 10 in advance to connect the connection region 14 to the terminal fitting 20 by crimping the crimping pieces 29 formed on the side edge of the bottom plate 22 to the side edge of the ceiling plate 23, with the crimping pieces 29 holding the connection region 14 between the bottom plate 22 and the ceiling plate 23. Therefore, it is easy to place the terminal fitting 20 in position and it is unnecessary to perform the work of piercing the crimping piece 29 into the FFC 10. Thus, the work of connecting the terminal fitting 20 to the connection region 14 by crimping the terminal fitting 20 can be accomplished simply and efficiently.

The present invention is not limited to the embodiment described above with reference to the drawings. For example, the following embodiments are included in the technical scope of the present invention. Further, various modifications can be made without departing from the spirit and scope of the present invention.

In the illustrated embodiment, the terminal fitting is connected to the connection region of the FFC after the terminal of the FFC 10 is cut. However, it is possible to connect the terminal fitting to the connection region after the terminal fitting is connected to the terminal of the FFC.

In the illustrated embodiment, the present invention is applied to the terminal fitting of surface contact type that is connected to the conductive path, with one surface of the insulation sheet torn off. However, the present invention is also applicable to the terminal fitting of through type that is connected to the conductive path by piercing a contact blade into the conductive path, with the conductive path embedded in the insulation sheet.

It is possible to configure each of the terminal fittings so that the rear side is extended and so that the rear end of each terminal fitting is connected to the terminal of the FFC not separated into a plurality of connection regions. In this case, it is possible to allow the terminal fittings to have a separated state in a predetermined length and to accommodate the terminal fittings in respective cavities. This construction also is included in the technical scope of the present invention.

The present invention can be used to connect the male terminal fitting to the FFC.

It is possible to apply the present invention not only to the FFC exemplified in the illustrated embodiment, but also terminal fittings to be used in connection with the terminal of the flat conductor, such as an FPC (flexible print circuit board), in which the conductive path is covered with the insulation layer.

What is claimed is:

1. A connector assembly comprising:

a flat flexible cable having an end and a plurality of spaced-apart conductive paths, insulation layers covering opposite sides of said conductive paths at locations spaced from said end, such that connection regions are defined adjacent said end, said connection regions and spaces between said conductive paths in said connection regions being free of said insulation layers;

a connector housing having opposed front and rear ends and a plurality of separate cavities extending between said front and rear ends, said plurality of separate cavities defining a number of cavities that is greater than the plurality of conductive paths on the flat flexible cable, internal partition walls disposed between said cavities and extending from the front end of the connector housing entirely to the rear end of the connector housing, such that said partition walls are continuous and free of notches at said rear end of said connector housing;

a plurality of terminal fittings, each said terminal fitting having opposed front and rear ends, a connection part extending rearwardly from the front end of each said terminal fitting for connection with a mating terminal fitting, a mounting end extending forwardly from the rear end of each said terminal fitting, the mounting ends being connected to the exposed conductive paths on the flat conductor in the connection region, each said terminal fitting defining a cross-section configured and dimensioned for insertion into the respective cavities and defining lengths dimensioned for accommodating all of each said terminal fitting in the respective cavity; and at least one wire-mounted terminal fitting connected to a separate wire, said wire-mounted terminal fitting and a portion of said wire being engaged in one of said cavities.

2. A connector assembly comprising:

a flat flexible cable having an end, a plurality of spaced-apart conductive paths extending from said end, insulation sheets covering said conductive paths at locations spaced from said end, connection regions adjacent said end, portions of each of said conductive paths in said connection regions having an exposed region free of said insulation sheets and portions of said connection regions between said conductive paths being free of said insulation sheet, a plurality of terminal fittings, each said terminal fitting having opposed front and rear ends, a connection part extending rearwardly from the front end, a base plate extending from said connection part to said rear end, a ceiling plate being pivotally connected to said terminal fitting at a location between said ends, said exposed conductive region of each said conductive path being tightly pressed between said bottom plate and said ceiling plate;

a connector housing having opposed front and rear ends, a plurality of cavities extending between the front and rear ends, said plurality of separate cavities defining a number of cavities that is greater than the plurality of conductive paths on the flat flexible cable, a plurality of partitioning wall extending substantially continuously between said front and rear ends and separating said cavities, said partition walls being continuous and free of notches at said rear ends, said cavities being substantially identical and defining cross-sections and lengths selected for accommodating all of each said terminal fitting therein from the rear end of the connector housing, and at least one wire-mounted terminal fitting connected to a separate wire, said wire-mounted terminal fitting and a portion of said wire being engaged in one of said cavities.

* * * * *